US011118848B2

(12) United States Patent
Zhang et al.

(10) Patent No.: US 11,118,848 B2
(45) Date of Patent: Sep. 14, 2021

(54) HEAT-EXCHANGING PLATE, AND PLATE HEAT EXCHANGER USING SAME

(71) Applicant: Danfoss Micro Channel Heat Exchanger (Jiaxing) Co., Ltd., Zhejiang (CN)

(72) Inventors: Zhifeng Zhang, Zhejiang (CN); Wenjian Wei, Zhejiang (CN)

(73) Assignee: DANFOSS MICRO CHANNEL HEAT EXCHANGER (JIAXING) CO., LTD., Zhejiang (CN)

( * ) Notice: Subject to any disclaimer, the term of this patent is extended or adjusted under 35 U.S.C. 154(b) by 272 days.

(21) Appl. No.: 16/072,565

(22) PCT Filed: Jan. 25, 2017

(86) PCT No.: PCT/CN2017/072605
§ 371 (c)(1),
(2) Date: Aug. 20, 2019

(87) PCT Pub. No.: WO2017/133618
PCT Pub. Date: Aug. 10, 2017

(65) Prior Publication Data

US 2019/0376749 A1 Dec. 12, 2019
US 2021/0180881 A9 Jun. 17, 2021

(30) Foreign Application Priority Data

Feb. 4, 2016 (CN) ..... 201610079174.0

(51) Int. Cl.
*F28F 13/12* (2006.01)
*F28F 3/04* (2006.01)
*F28D 9/00* (2006.01)

(52) U.S. Cl.
CPC ..... *F28F 3/044* (2013.01); *F28D 9/005* (2013.01)

(58) Field of Classification Search
CPC .. F28F 3/044; F28F 3/025; F28F 3/046; F28F 27/02; F28F 2250/102; F28D 9/00
(Continued)

(56) References Cited

U.S. PATENT DOCUMENTS 4,253,520 A * 3/1981 Friedericy ..... F28D 9/0031 165/134.1
5,398,751 A * 3/1995 Blomgren ..... F28D 9/005 165/166

(Continued)

FOREIGN PATENT DOCUMENTS

CN 101069058 A 11/2007
CN 101261057 A 9/2008

(Continued)

OTHER PUBLICATIONS

Supplementary European Search Report for Serial No. EP 17746938.4 dated Oct. 4, 2019.

(Continued)

*Primary Examiner* — Claire E Rojohn, III
(74) *Attorney, Agent, or Firm* — McCormick, Paulding & Huber PLLC

(57) ABSTRACT

A heat-exchanging plate (20), and plate heat exchanger (100) using same. The heat-exchanging plate (20) comprises concave locations (22) and/or convex locations (23), and is provided with multiple heat-exchanging units thereon. At least one inlet and/or at least one outlet of at least one of the heat-exchanging units is controllable.

18 Claims, 8 Drawing Sheets

(58) Field of Classification Search
USPC ..... 165/109.1
See application file for complete search history.

(56) References Cited

U.S. PATENT DOCUMENTS 10,066,879 B2 * 9/2018 Wei ..... F28F 3/04
10,113,814 B2 * 10/2018 Persson ..... F28F 3/044
10,145,625 B2 * 12/2018 Persson ..... F28F 3/083
10,323,883 B2 * 6/2019 Zhang ..... F28F 3/042
10,443,955 B2 * 10/2019 Tison ..... F28D 1/0341
10,473,403 B2 * 11/2019 Persson ..... F28D 9/0093
10,677,538 B2 * 6/2020 Shin ..... F28D 5/02
D889,420 S * 7/2020 Shin ..... D13/179
10,876,801 B2 * 12/2020 Zhang ..... F28F 3/025
2004/0069473 A1 * 4/2004 Blomgren ..... F28F 3/04 165/167
2007/0006998 A1 * 1/2007 Brost ..... F28D 9/005 165/167
2008/0202735 A1 * 8/2008 Geskes ..... F28D 9/0043 165/166
2011/0011568 A1 * 1/2011 Han ..... F28D 9/0043 165/133
2011/0180247 A1 * 7/2011 Persson ..... F28D 9/005 165/185
2012/0266599 A1 * 10/2012 Berger ..... F28F 9/026 60/716
2013/0153184 A1 * 6/2013 Rolt ..... F28D 9/0037 165/166
2016/0109190 A1 * 4/2016 Olesen ..... F28F 3/12 165/170
2017/0219296 A1 * 8/2017 Wei ..... F28F 3/048

FOREIGN PATENT DOCUMENTS

CN 104132576 A 11/2014
CN 205784791 U 12/2016
EP 1684044 A2 7/2006
EP 2607831 A1 6/2013
JP H11173771 A 7/1999
JP 2008116138 A 5/2008

OTHER PUBLICATIONS

International Search Report for PCT Serial No. PCT/CN2017/072605 dated Apr. 17, 2017.

* cited by examiner

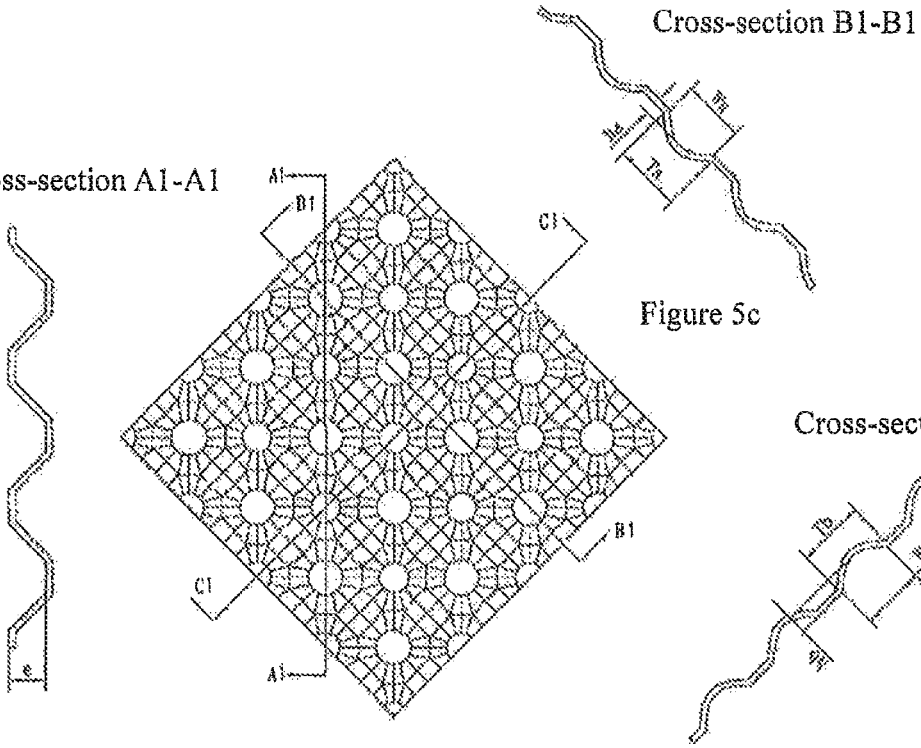
Figure 5c
Figure 5b Figure 5a Figure 5d
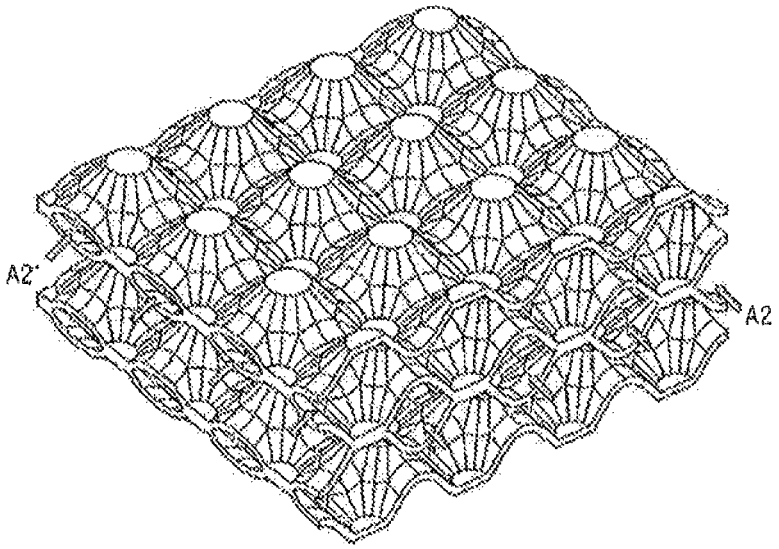
Figure 6

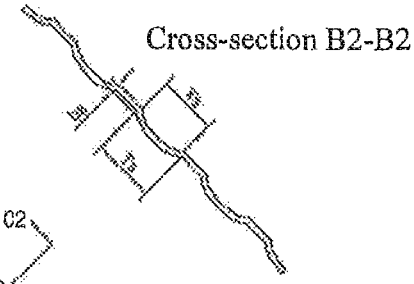
Figure 7c
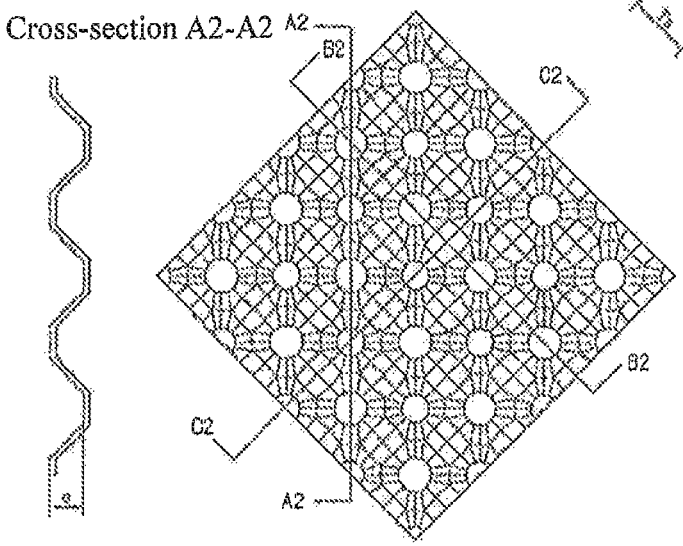
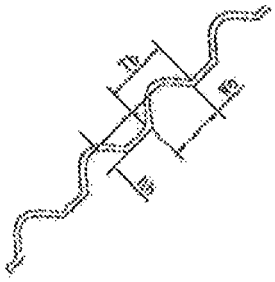
Figure 7b
Figure 7a
Figure 7d
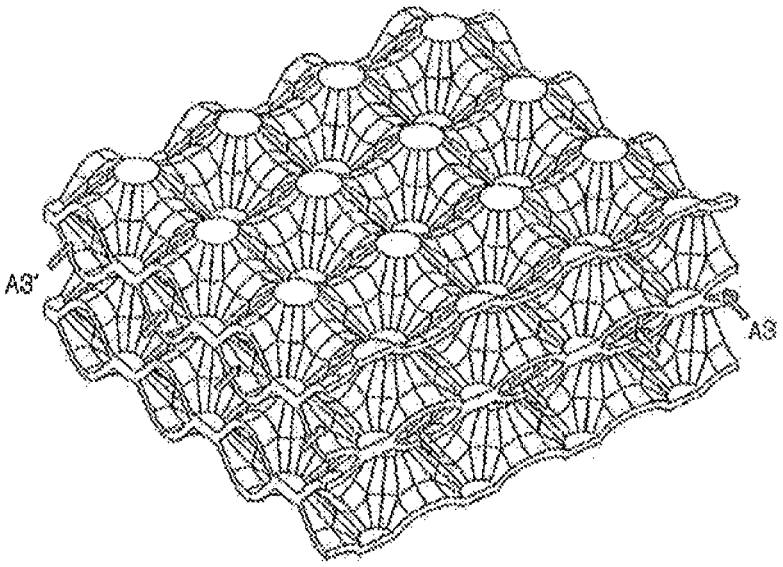
Figure 8

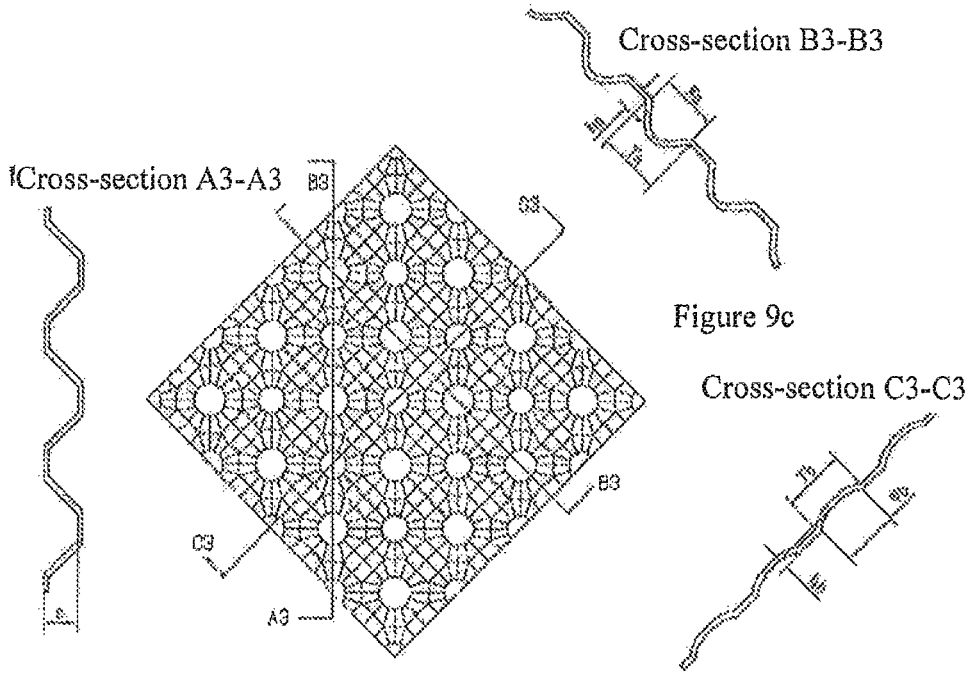
Figure 9c
Figure 9b
Figure 9a
Figure 9d
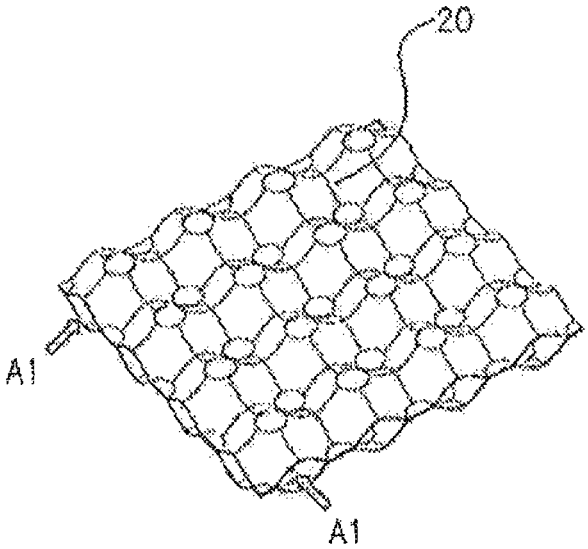
Figure 10

HEAT-EXCHANGING PLATE, AND PLATE HEAT EXCHANGER USING SAME

CROSS-REFERENCE TO RELATED APPLICATIONS

This application is a National Stage application of International Patent Application No. PCT/CN2017/072605, filed on Jan. 25, 2017, which claims the priority of Chinese Patent Application No. 201610079174.0, filed on Feb. 4, 2016, each of which is all incorporated by reference into this application.

TECHNICAL FIELD

The present invention relates to the technical fields of refrigeration & air conditioning, petrochemical engineering, and district heating, etc., and in particular relates to a plate type heat exchanger and the heat exchanging plate for the plate type heat exchanger in these technical fields.

BACKGROUND

In the heat exchanging field, increasing the turbulence intensity to enhance heat exchanging is an important way of strengthening heat exchanging. For a conventional dimple heat exchanging plate, the main flow direction is on the same plane and the flow of a fluid is basically an approximate 2-dimensional flow along the plate sheet of the heat exchanging plate.

SUMMARY

The objective of the present invention is to solve at least one aspect of the above-mentioned technical problems and defects in the prior art.

According to one aspect of the present invention, a heat exchanging plate is provided, and said heat exchanging plate comprises depressions and/or protrusions, said heat exchanging plate is provided thereon with a plurality of heat exchanging units, and at least one inlet and/or at least one outlet of said at least one heat exchanging unit are/is restricted.

In one exemplary embodiment, at least one inlet and/or at least one outlet of at least one heat exchanging unit on said heat exchanging plate have/has a cross-section different from those of the inlets and/or outlets of other heat exchanging units.

In one exemplary embodiment, at least one inlet and/or at least one outlet of said at least one heat exchanging unit are/is configured to be adjustable, with the layout and welding spot profile of said heat exchanging unit not changed.

In one exemplary embodiment, the transitional curved surface between adjacent depressions and/or protrusions in at least one heat exchanging unit of said heat exchanging plate is configured to be restricted.

In one exemplary embodiment, at least one of the pressure drop, heat exchanging performance and volume of the whole plate type heat exchanger is regulated through at least one of the following parameters of at least some areas of said heat exchanging plate:

Ta: edge spacing between two adjacent protrusions or the shortest distance between two adjacent protrusions on said heat exchanging plate, Tb: edge spacing between two adjacent depressions or the shortest distance between two adjacent depressions, wherein the distance connection line of said Tb and the distance connection line of said Ta intersect each other in space, Ha: vertical distance between the highest location of the heat exchanging plate and the lowest location of an upper surface of a depressed transitional curved line connected across Ta, Hb: vertical distance between the lowest location of the heat exchanging plate and the highest location of a lower surface of a protruded transitional curved line connected across Tb, Wa: distance between the two ends of the curved line corresponding to Ha, Wb: distance between the two ends of the curved line corresponding to Hb, e: vertical distance between the highest location and depressions on the top surface of the heat exchanging plate, or vertical distance between the lowest location and protrusions on the bottom surface of the heat exchanging plate.

In one exemplary embodiment, the pressure drop on the two sides, heat exchanging performance, volume and/or asymmetry of the heat exchanging plate are/is regulated by adjusting Ha and Hb of at least some areas to regulate the minimum flow cross-section of the inlet on at least one side of the heat exchanging unit, with Ta and Tb of said at least some areas of the heat exchanging plate not changed.

In one exemplary embodiment, said adjusting of the parameters Ha and Hb comprises increasing Hb while reducing Ha, or reducing Hb while increasing Ha.

In one exemplary embodiment, said parameters satisfy the following relationship:

$$Ha \approx \frac{Ta}{Ta+Tb} \times e,\ Hb \approx \frac{Tb}{Ta+Tb} \times e.$$

According to another aspect of the present invention, a plate type heat exchanger is provided, said plate type heat exchanger comprises a plurality of stacked above-mentioned heat exchanging plates, and a heat exchanging passage is formed between two adjacent stacked heat exchanging plates.

In one exemplary embodiment, the corresponding heat exchanging units in two adjacent heat exchanging plates cooperate with each other to form a basic heat exchanging cell when said heat exchanging passage is formed, and the cross-section shape of at least one inlet of at least one of said basic heat exchanging cells is asymmetric with respect to the plate plane, wherein said plate plane is the welding planes of two adjacent heat exchanging plates.

In one exemplary embodiment, the cross-section of said at least one inlet has different heights on the two sides of the plate plane.

In one exemplary embodiment, the center of gravity of the cross-section of said at least one inlet is not on said plate plane.

In one exemplary embodiment, at least one outlet of at least one of said basic heat exchanging cells is asymmetric with respect to the plate plane.

In one exemplary embodiment, when a fluid flows past a plurality of basic heat exchanging cells in said heat exchanging passage, a plurality of said basic heat exchanging cells are configured to allow the fluid to undulate up and down relative to the plate plane.

In one exemplary embodiment, the cross-sectional height and/or cross-sectional area of the cross-section of at least one inlet and/or outlet above said plate plane are/is greater than the cross-sectional height and/or cross-sectional area below said plate plane, and the cross-sectional height and/or cross-sectional area of the cross-section of the cross-section of at least one inlet and/or outlet above said plate plane are/is smaller than the cross-sectional height and/or cross-sectional area below said plate plane.

In one exemplary embodiment, the center of gravity of the cross-section of said at least one inlet and/or outlet is above and/or below said plate plane.

In one exemplary embodiment, said at least one inlet is arranged alternately or arranged in accordance with a preset rule, and/or said at least one outlet is arranged alternately or arranged in accordance with a preset rule.

In one exemplary embodiment, a plurality of said basic heat exchanging cells are configured to allow a fluid to undulate up and down relative to the plate plane in a single flow direction and/or a plurality of flow directions of the fluid.

In one exemplary embodiment, the cross-sectional area of the cross-section of said at least one inlet and/or at least one outlet in one direction on said plate plane is greater than the cross-sectional area of the cross-section in another direction.

BRIEF DESCRIPTION OF THE DRAWINGS

These and/or other aspects and the advantages of the present invention will become obvious and will be easily understood from the following description of preferred embodiments in combination with the drawings, in which FIGS. 5*a*, 5*b*, 5*c*, and 5*d* are a top view of a part of the first heat exchanging plate shown in FIG. 4, and sectional views in the directions of A1-A1, B1-B1 and C1-C1, respectively, FIG. 6 is a 3-D view of a part of the structure formed when four heat exchanging plates shown in FIG. 2 are stacked to form a heat exchanging passage after adjustments are made to one embodiment of the present invention, wherein the arrow in the figure indicates the flow direction of a fluid, FIGS. 7*a*, 7*b*, 7*c* and 7*d* are a top view of a part of the first or top heat exchanging plate shown in FIG. 6, and sectional views in the directions of A2-A2, B2-B2 and C2-C2, respectively, FIG. 8 is a 3-D view of a part of the structure formed when four heat exchanging plates shown in FIG. 2 are stacked to form a heat exchanging passage after adjustments are made to another embodiment of the present invention, wherein the arrow in the figure indicates the flow direction of a fluid, FIGS. 9*a*, 9*b*, 9*c* and 9*d* are a top view of a part of the first or top heat exchanging plate shown in FIG. 8, and sectional views in the directions of A3-A3, B3-B3 and C3-C3, respectively, FIG. 10 is a schematic diagram for a part of two stacked heat exchanging plates after adjustments are made to another embodiment of the present invention, FIGS. 11*a* to 11*d* are a top view and sectional views of the structure shown in FIG. 10 in the directions of A4-A4, B4-B4 and C4-C4, FIGS. 14*a* to 14*g* are respectively a top view and sectional views of a partial structure of two stacked heat exchanging plates, in the directions of A6-A6, B6-B6, C6-C6, E-E, F-F and G-G, after adjustments are made to a further embodiment of the present invention.

DETAILED DESCRIPTION

The following gives embodiments to further describe in detail the technical solution of the present invention in combination with the drawings. In the description, the same or similar reference number indicates the same or similar component. The description of the embodiments of the present invention by reference to the drawings is intended to explain the overall inventive concept of the present invention, but should not be interpreted as a restriction of the present invention.

Figure 1:
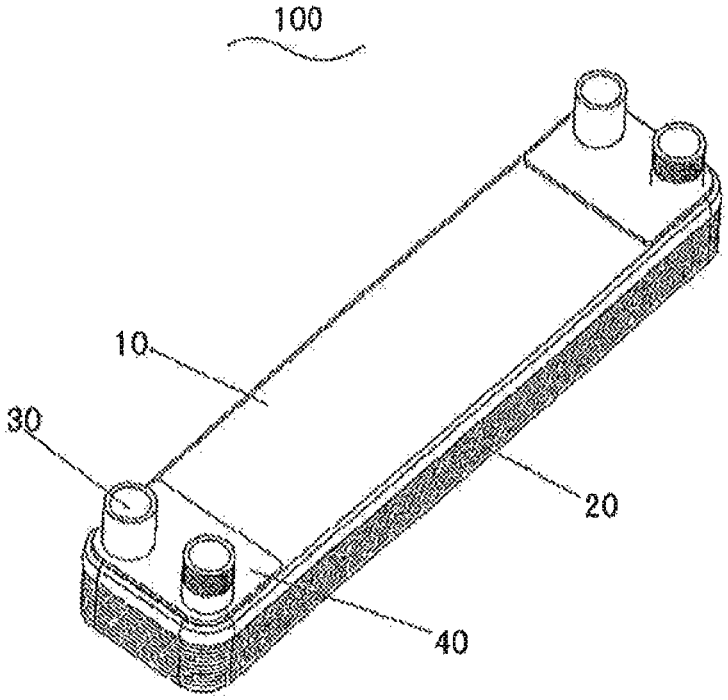
FIG. 1 is a 3-D view of the plate type heat exchanger according to one embodiment of the present invention.

FIG. 1 is a perspective view of the plate type heat exchanger (100) according to one embodiment of the present invention. The plate type heat exchanger (100) mainly comprises two end plates (10) located on the top and bottom sides, heat exchanging plates (20) located between the above-mentioned two end plates (10), connecting pipes (30) located at the inlet and outlet of the plate type heat exchanger (100), and reinforced plates (40) provided at the inlet and the outlet, etc.

Figure 2:
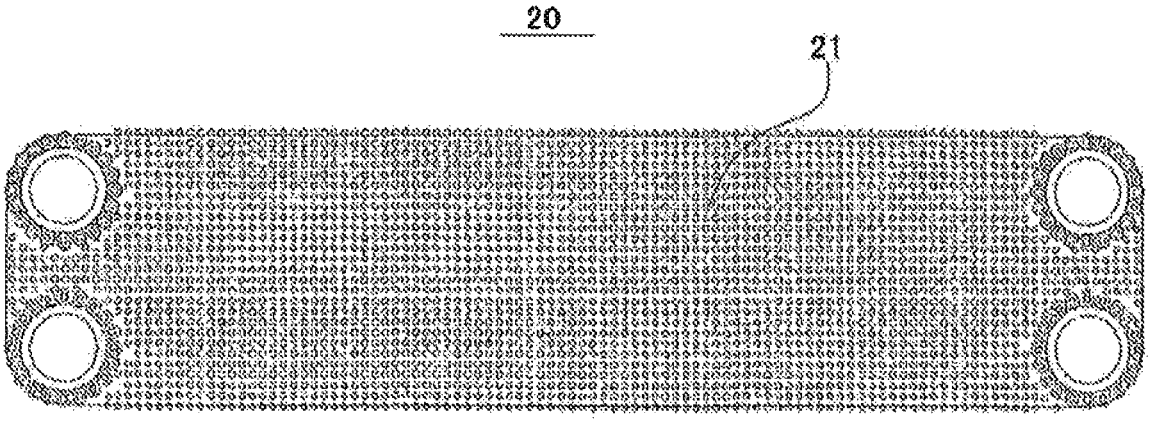
FIG. 2 is a top view of a heat exchanging plate in FIG. 1, FIGS. 3*a*, 3*b*, and 3*c* are respectively a top view, a side view, and a 3-D view of a part of the heat exchanging plate in FIG. 2.

From FIG. 2, it can be seen that the main heat exchanging units of the heat exchanging plate (20) consist of dimple units (21). When fluids flow past the heat exchanging plate (20), the cold fluid and the warm fluid located on the two sides of the heat exchanging plate (20) are separated by the plate sheet of the heat exchanging plate (20) and heat is exchanged through the plate sheet of the heat exchanging plate (20).

Figure 3A:
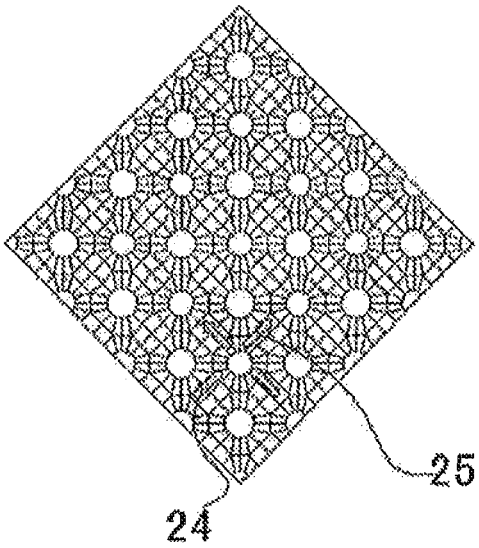
Figure 3B:
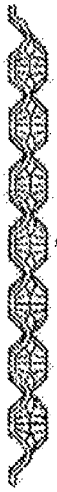
Figure 3C:
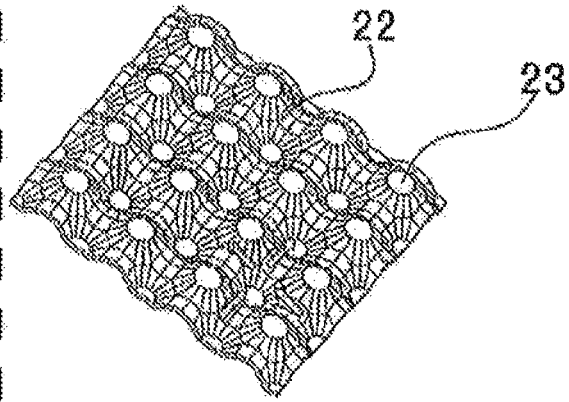

As shown in FIGS. 3*a* to 3*c*, the heat exchanging plate (20) comprises a plurality of depressions (22) and/or protrusions (23). Said plurality of depressions (22) and/or protrusions (23) form the heat exchanging units on the heat exchanging plate (20). It can be seen that the number of depressions (22) and/or protrusions (23) included in each heat exchanging unit is not specifically restricted, and those skilled in the art can set their specific number as required. That is to say, a plurality of such heat exchanging units are provided on the two sides of the plate sheet of the heat exchanging plate (20). At least one inlet (24) and/or at least one outlet (25) of the flow paths of at least one heat exchanging unit are/is restricted.

It should be noted that "at least one inlet and/or at least one outlet are/is restricted" here means that the inlet and/or outlet can be controlled or regulated as expected, but is unnecessarily regular or uniform. The dimple units on heat exchanging plate on the prior art dimple heat exchanger are all regular, that is to say, each dimple unit has the same shape and depth, and therefore, it is difficult to make more changes as required. Compared with a dimple plate type heat exchanger or a plate type heat exchanger with a similar structure, the inlet and outlet of the heat exchanging unit in the present invention can be regulated as required to achieve a higher heat exchanging efficiency, different inlet and outlet cross-sections of heat exchanging units can be adopted for different areas of the plate sheet to achieve a better fluid separation of the whole plate sheet, and if different heat exchanging units need to be adopted for different areas, only the inlets and outlets of the heat exchanging units need to be adjusted, without any change to the layout or welding spot profile of the heat exchanging units needed.

That is to say, for a heat exchanging plate of a conventional dimple heat exchanger, the main flow direction is on the same plane and the flow of a fluid is basically an approximate 2-dimensional flow along the plate sheet of the heat exchanging plate (20). By contrast, ups and downs of the reference plane of the main fluid are realized by adjusting the reference plane of the dimple units on the plate sheet of the heat exchanging plate (20) in the present invention, and besides the approximate 2-dimensional flow along the surface of the plate sheet, a flow in the depth direction of the plate sheet is realized, and thus a 3-dimensional flow of the fluid is realized, which can greatly enhance the heat exchanging effect.

In one exemplary embodiment, at least one inlet (24) and/or at least one outlet (25) of the flow paths of at least one heat exchanging unit on the heat exchanging plate (20) have/has a cross-section different from those of the inlets and/or outlets of other heat exchanging units. Here said flow paths refers to the passages which are used for different fluids to pass on the heat exchanging plate (20). Further, at least one inlet (24) and/or at least one outlet (25) of the flow paths of at least one heat exchanging unit can be further configured to be adjustable, that is to say, special cross-sections and structures, etc. can be configured for special areas, with the layout and welding spot profile of the heat exchanging unit not changed.

In one exemplary embodiment, the profiles and/or areas of the minimum flow cross-sections (A2 and A2') of the flow paths on the two adjacent sides in at least some areas of said heat exchanging plate (20) are different. It can be understood that the minimum flow cross-section (A2) is used for a first fluid, while the other minimum flow cross-section (A2') is used for a second fluid.

Further, the transitional curved surface between adjacent depressions (22) and/or protrusions (23) in at least one heat exchanging unit of the heat exchanging plate (20) are/is configured to be restricted, that is to say, said transition surface is configured to be regulated or controlled as expected.

In one exemplary embodiment of the present invention, at least one of the pressure drop, heat exchanging performance and volume of the whole plate type heat exchanger (100) is regulated through at least one of the following parameters of at least some areas of the heat exchanging plate (20):

Ta: edge spacing between two adjacent protrusions (23) or the shortest distance between two adjacent protrusions (23) on said heat exchanging plate (20), Tb: edge spacing between two adjacent depressions (22) or the shortest distance between two adjacent depressions (22), wherein the distance connection line of said Tb and the distance connection line of said Ta intersect each other in space, Ha: vertical distance between the highest location of the heat exchanging plate (20) and the lowest location of an upper surface of a depressed transitional curved line connected across Ta, Hb: vertical distance between the lowest location of the heat exchanging plate (20) and the highest location of a lower surface of a protruded transitional curved line connected across Tb, Wa: distance between the two ends of the curved line corresponding to Ha, Wb: distance between the two ends of the curved line corresponding to Hb, and e: vertical distance between the highest location and depressions on the top surface of the heat exchanging plate (20), or vertical distance between the lowest location and protrusions on the bottom surface of the heat exchanging plate (20).

Said two protrusions and said two depressions share a transition surface.

The pressure drop on the two sides, heat exchanging performance, volume and/or asymmetry of the heat exchanging plate are/is regulated by adjusting Ha and Hb of at least some areas to regulate the minimum flow cross-section of the inlet (24) on at least one side of the heat exchanging unit, with Ta and Tb of said at least some areas of the heat exchanging plate (20) not changed.

Figure 4:
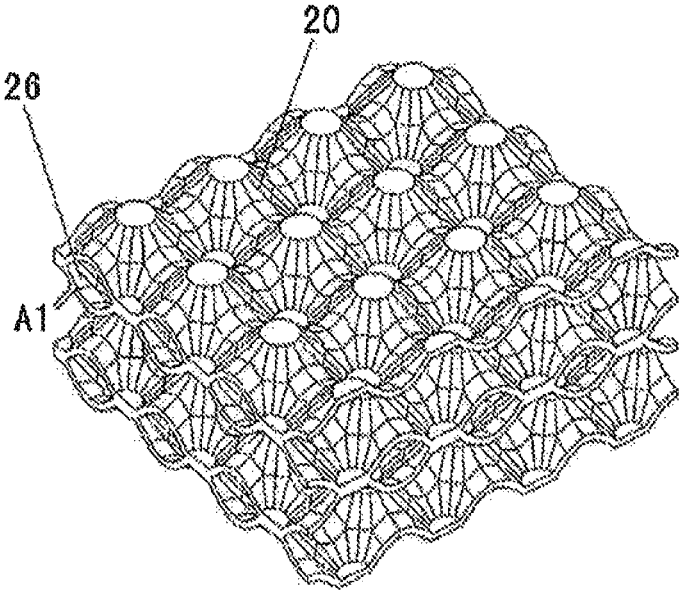
FIG. 4 is a 3-D view of a part of the structure formed when four heat exchanging plates shown in FIG. 2 are stacked to form a heat exchanging passage.

As shown in FIG. 4, a plurality of said heat exchanging plates (20) are stacked together to form said plate type heat exchanger (100), and a heat exchanging passage (26) is formed between two adjacent stacked heat exchanging plates (20). Adjacent heat exchanging passages (26) are separated by the plate sheet of the heat exchanging plate (20). The heat exchanging passage (26) is formed through the cooperation of the corresponding flow paths of the two adjacent heat exchanging plates (20) above and below.

As shown in FIGS. 5*a* to 5*d*, regarding the plate sheet of a dimple heat exchanging plate, after the dimple depth, dimple spacings Ta and Tb, and thickness of the plate sheet are determined, the parameters Wa and Wb shown in FIGS. 5*c* and 5*d* are also determined, and the corresponding parameters Ha and Hb are also determined according to conventional practice in the prior art. In this way, the minimum flow cross-section (A1) (namely, the minimum cross-section of the heat exchanging passage (26)) shown in FIG. 4 is also restricted. Thus, the pressure drop, heat exchanging performance and volume of the plate sheet of the whole heat exchanging plate (20) also cannot be changed.

For example, in FIGS. 5*a* to 5*d*, if Ta=Tb, then Wa=Wb and Ha=Hb according to the principle of free form. Naturally, a plate sheet with two symmetrical sides and the heights Ha=Hb=e/2 of the transition surface can be obtained. As a result, the pressure drop on the two sides, the heat exchanging performance and the volume cannot be regulated after the design of the dimple structure is completed. Likewise, the asymmetry of the two sides cannot be regulated either.

For example, in FIGS. 6 to 7*d*, the minimum flow cross-section (A2') can freely be regulated within a certain range to regulate the pressure drop on the two sides, the heat exchanging performance, the volume and the asymmetry by adjusting the parameters Ha and Hb, with the parameters Ta and Tb not changed. That is to say, two types of inlets for a first fluid and a second fluid are provided on the two sides of the heat exchanging plate (20) shown in FIG. 6, wherein the minimum flow cross-section of the inlet on the right side is A2, and the minimum flow cross-section of the inlet on the left side is A2'. Obviously, the minimum flow cross-section (A2') is reduced relative to the other minimum flow cross-section (A2).

First, for example, the parameter Hb is increased while the parameter Ha is reduced so that the minimum flow cross-section on the shown side of the heat exchanging plate is increased, the pressure drop is reduced, and the volume is increased.

Next, for example, the parameter Hb is reduced while the parameter Ha is increased as shown in FIGS. 8 to 9*d* so that the minimum flow cross-section (A3) on the shown side of the heat exchanging plate (20) is reduced, the pressure drop is increased, and the volume is reduced. That is to say, two types of similar inlets are provided on the two sides of the heat exchanging plate (20) shown in FIG. 8, wherein the minimum flow cross-section of the inlet on the right side is A3, and the minimum flow cross-section of the inlet on the left side is A3'. Obviously, the minimum flow cross-section (A3') is increased relative to the other minimum flow cross-section (A3).

In summary, the step of adjusting the parameters Ha and Hb comprises increasing Hb while reducing Ha, or reducing Hb while increasing Ha.

Said parameters satisfy the following relationship:

$$Hb \approx \frac{Tb}{Ta + Tb} \times e.$$

See FIG. 10 and FIG. 4. When said heat exchanging passage (26) is formed, the corresponding heat exchanging units in two adjacent exchanging plates (20) cooperate with each other to form a basic heat exchanging cell. As shown in the figures, the basic heat exchanging cell can be considered a basic cell, the small opening indicated by the marker (A1) is the minimum flow cross-section of the heat exchanging passage (26), and the minimum flow cross-section can be considered the cross-section of the inlet and outlet of the basic heat exchanging cell. The basic heat exchanging cell is formed by stacking two types (A and B) of heat exchanging plates, wherein the heat exchanging passage is formed by combining the fluid passage between said type A and type B heat exchanging plates.

See FIG. 6 and FIG. 8 again. The cross-section profiles and/or areas of the heat exchanging passage (26) between said two adjacent heat exchanging plates (20) on two adjacent sides of any of said two heat exchanging plates (20) are different. In particular, the minimum flow cross-section profiles and/or areas of said heat exchanging passage (26) on said two adjacent sides can also be configured to be different.

In a plate type heat exchanger, different fluids flow in the heat exchanging passages on the two surfaces of the same heat exchanging plate (20) to realize heat exchanging.

FIG. 6 shows that two types of inlets are provided on the two sides of two stacked heat exchanging plates (20), wherein the minimum flow cross-section of the inlet of the heat exchanging passage (26) on the right side is A2, and the minimum flow cross-section of the inlet of the heat exchanging passage (26) on the left side is A2'. Obviously, the minimum flow cross-section (A2') is reduced relative to the other minimum flow cross-section (A2). Since the inlet of said heat exchanging passage (26) is formed through the cooperation of the corresponding flow paths of two adjacent heat exchanging plates (20), the minimum flow cross-section profiles and/or areas of the flow paths on the two adjacent sides in at least some areas of the heat exchanging plate (26) are different.

By the same reasoning, FIG. 8 shows that two types of inlets are provided on the two sides of two stacked heat exchanging plates (20), wherein the minimum flow cross-section of the inlet of the heat exchanging passage (26) on the right side is A3, and the minimum flow cross-section of the inlet of the heat exchanging passage on the left side is A3'. Obviously, the minimum flow cross-section (A3') is increased relative to the other minimum flow cross-section (A3). Since the inlet of said heat exchanging passage (26) is formed through the cooperation of the flow paths of two heat exchanging plates (20), correspondingly the minimum flow cross-section profiles and/or areas of the flow paths on the two adjacent sides in at least some areas of the heat exchanging plate (26) are different.

Figure 11A:
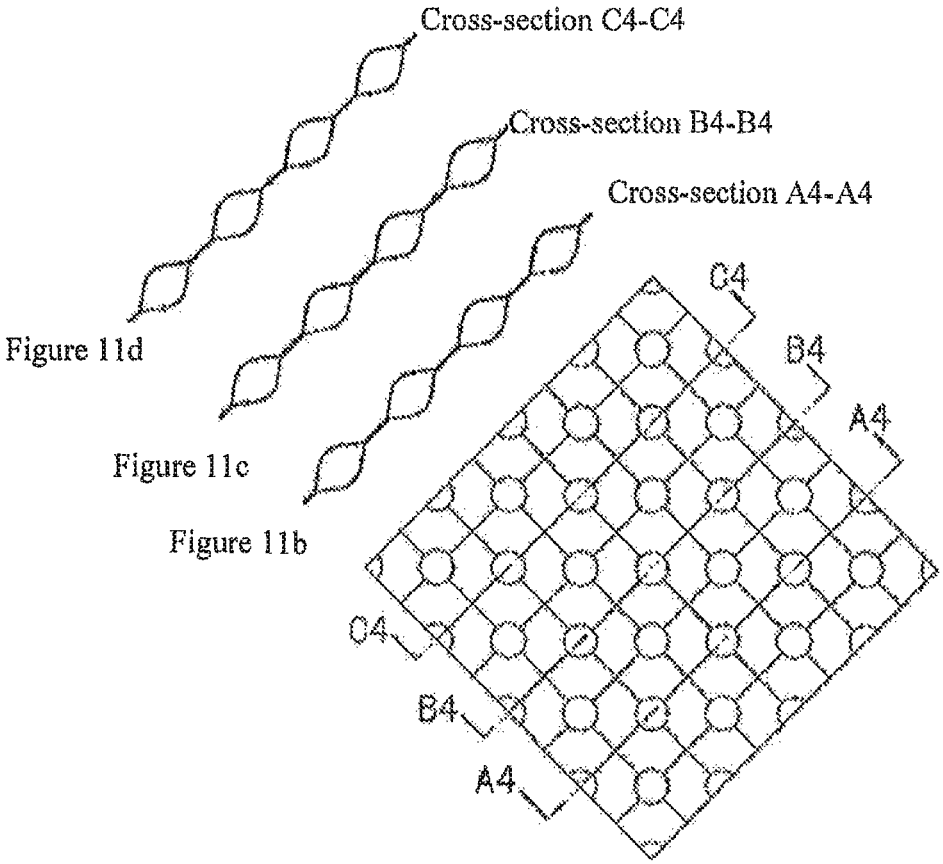

FIGS. 10 to 11*d* show a conventional basic heat exchanging cell, wherein the small opening A2 is the inlet fora fluid. It can be seen from the figures that the shape of the inlet is a symmetrical mouth and the two portions above and below the central symmetrical plane are completely symmetrical and identical fluid forms.

When a fluid sequentially passes the cross-sections in the directions of A4-A4, B4-B4 and C4-C4, the fluid always flows along a symmetrical passage.

Figure 12:
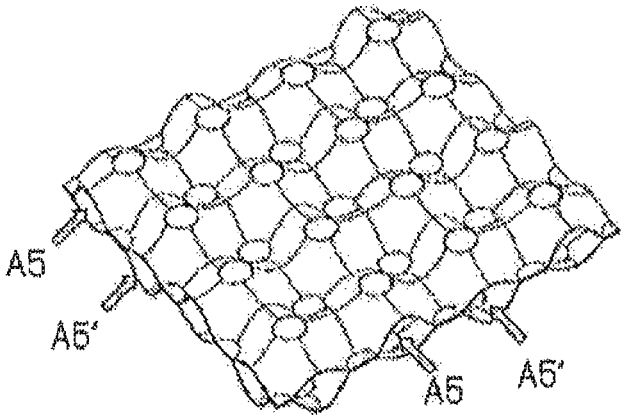
FIG. 12 is a schematic diagram for a part of two stacked heat exchanging plates after adjustments are made to another embodiment of the present invention.
Figures 13A, 13B, 13C, 13D:
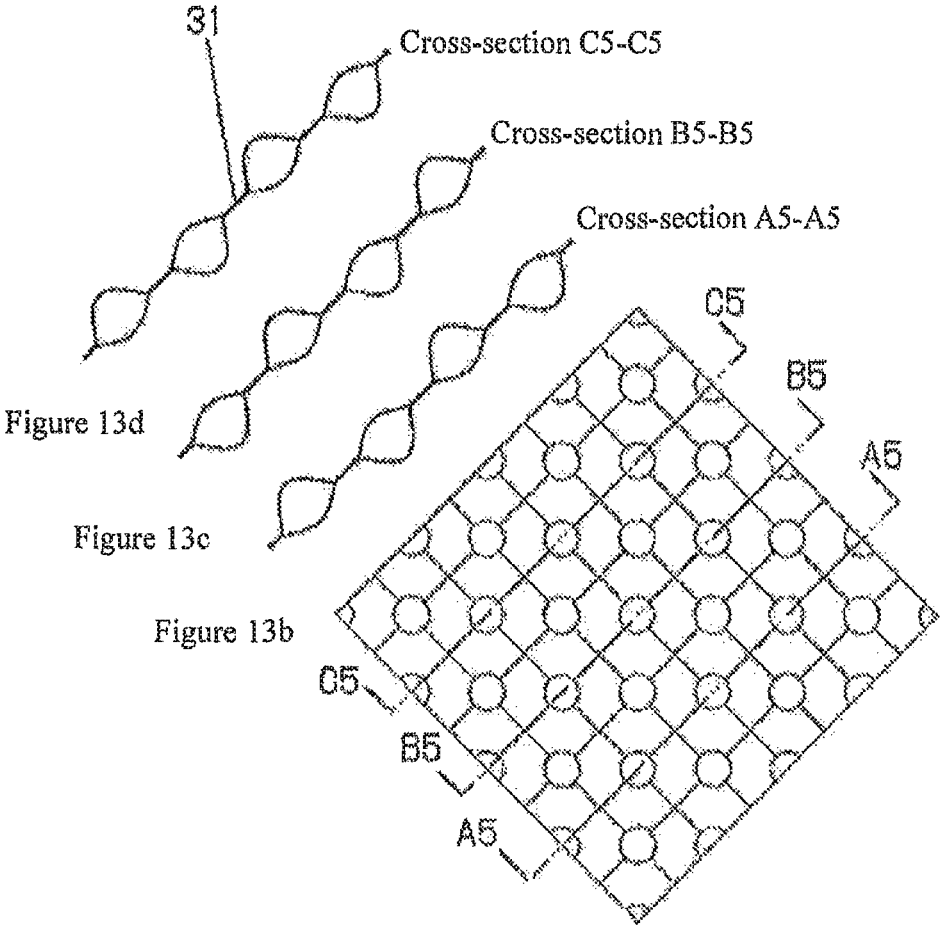
FIGS. 13*a* to 13*d* are respectively a top view and sectional views of the structure shown in FIG. 12 in the directions of A5-A5, B5-B5 and C5-C5.
Figure 14A:
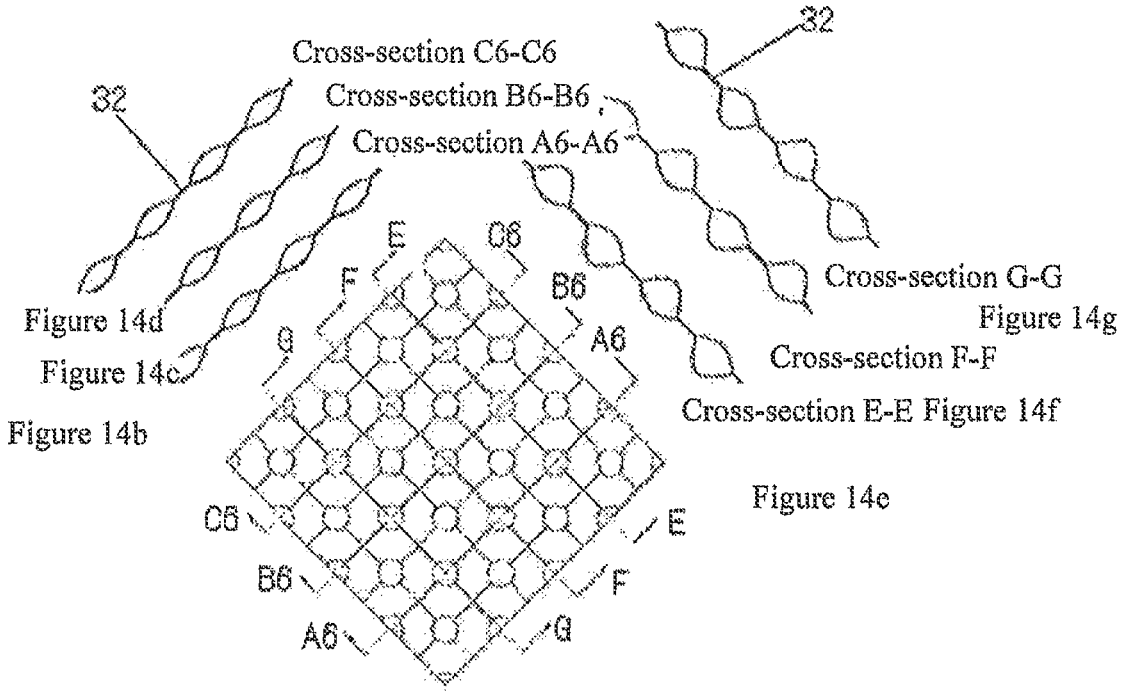

FIGS. 12 to 13*d* show an adjusted heat exchanging cell of the present invention, wherein small openings (A5 and A5') are the inlets for fluids. It can be seen from the figures that the shapes of the inlets are asymmetrical so that the flowage of the fluids is also asymmetrical. The asymmetry is more favorable for the turbulence of the fluids, promotes the heat exchange between the fluids, and improves the heat exchanging efficiency.

The structural characteristic of the basic heat exchanging cell shown in this case is that the fluid passage of a type A plate (for example, the top heat exchanging plate shown in the figures) and the fluid passage of the corresponding type B plate (for example, the bottom heat exchanging plate shown in the figures) are different. Therefore, the heat exchanging passage formed by the plate sheets of these two types of heat exchanging plates is asymmetrical.

When a fluid passes a first through-passage (A5-A5), the main stream deviates towards one side of the plate plane; when the fluid enters the next through-passage (B5-B5), the main stream deviates towards the other side of the plate plane; after that, the fluid alternately goes down and up so that the fluid can undulate up and down. In practice, the down-up-down-up alternation can be changed to down-down-up-up alternation, etc., as required.

Said at least one inlet (A5 and A5') is arranged alternately or arranged in accordance with a preset rule. By the same reasoning, said at least one outlet (not shown in the figures) can also be arranged alternately or arranged in accordance with a preset rule.

That is to say, the inlet and/or outlet with the cross-sectional height and/or cross-sectional area above the plate plane greater than the cross-sectional height and/or cross-sectional area below the plate plane, and the inlet and/or outlet with the cross-sectional height and/or cross-sectional area above the plate plane smaller than the cross-sectional height and/or cross-sectional area below the plate plane can be arranged alternately or arranged in accordance with a preset rule. Alternatively, the inlet and/or outlet with the center of gravity of the cross-section above said plate plane and the inlet and/or outlet with the center of gravity of the cross-section below said plate plane can be arranged alternately or arranged in accordance with a preset rule. Although only the inlet with the cross-sectional area of the cross-section in one direction on the plate plane (31) greater than the cross-sectional area of the cross-section in another direction is shown, the cross-sectional area of the cross-section of the outlet in one direction on the plate plane can also be set to be greater than the cross-sectional area of the cross-section in another direction, that is to say, the cross-sectional area of the cross-section of at least one inlet and/or at least one outlet in one direction on said plate plane is greater than the cross-sectional area of the cross-section in another direction.

As shown in FIGS. 14*a* to 14*g*, the flow cross-section is changed to guide the fluid distribution. As shown in the figures below, the cross-sectional area of the inlets of the cross-sections in the directions of A6-A6, B6-B6 and C6-C6 is smaller than the cross-sectional area of the inlets of the cross-sections in the directions of E-E, F-F and G-G. Thus, the flow rate of the fluid passing the cross-sections in the directions of E-E, F-F and G-G is high, the fluid more easily flows in the fluid passages (E-E, F-F and G-G), and fluid separation adjustment is realized. Undulations up and down of the fluid passing a cross-section in a single direction are shown. In practice, undulations up and down of the fluid in two directions or more directions can be realized, and will not be exemplified one by one here.

From the above-mentioned examples, it can be learned that the cross-section shape of at least one inlet of at least one of said basic heat exchanging cells is asymmetrical with respect to the plate plane (as shown in FIGS. 13*b* to 13*d*, FIGS. 14*b* to 14*d*, and FIGS. 14*e* to 14*g*), wherein said plate plane is the welding planes (31 and 32) of two adjacent heat exchanging plates (20).

In one exemplary embodiment, the cross-section shape of at least one inlet of at least one of said basic heat exchanging cells is symmetrical in one direction with respect to the plate plane, but is asymmetrical in another direction. Of course, the cross-section shape can also be symmetrical or asymmetrical in two directions, as long as the minimum flow cross-section in one direction is guaranteed to be greater or smaller than the minimum flow cross-section in another direction.

In the present exemplary embodiment, the cross-section sizes of at least one inlet in two directions are different so that the fluid tends to flow in one direction with a larger cross-section.

It can also be seen from the figures that the heights of the cross-sections of the inlets (A3 and A4) on the two sides of the plate plane (31 and 32) can be set to be different.

Further, the center of gravity of the cross-sections of said at least one inlet (A3 and A4) can also not be on said plate plane (31 and 32).

By the same reasoning, at least one outlet (not shown) of at least one of said basic heat exchanging cells can also be set to be asymmetric with respect to the plate planes.

In this way, when a fluid flows past a plurality of basic heat exchanging cells in said heat exchanging passage, a plurality of said basic heat exchanging cells are configured to allow the fluid to undulate up and down relative to the plate plane.

In addition, as shown in FIGS. 13*b* to 13*d* and FIGS. 14*b* to 14*d*, the cross-sectional height and/or cross-sectional area of the cross-section of at least one inlet (A5 and A5') and/or outlet above said plate plane (31 and 32) are/is greater than the cross-sectional height and/or cross-sectional area of the cross-section below the plate plane (31 and 32), and the cross-sectional height and/or cross-sectional area of the cross-section of at least one inlet (A5 and A5') and/or outlet above said plate plane (31 and 32) are/is smaller than the cross-sectional height and/or cross-sectional area below said plate plane (31 and 32). The center of gravity of the cross-section of said at least one inlet (A5 and A5') and/or outlet is above and/or below said plate plane (31 and 32). Said at least one inlet (A5 and A5') is arranged alternately or arranged in accordance with a preset rule, and/or said at least one outlet is arranged alternately or arranged in accordance with a preset rule.

Although a dimple heat exchanger is exemplified to describe in detail the present invention, those skilled in the art can understand that the design concept of the present invention is not limited to the above-mentioned dimple heat exchanger, but can similarly be used in a protrusion and depression plate type heat exchanger. That is to say, the design concept of the present invention can be applied to dimple plate type heat exchangers or various plate type heat exchangers with a similar structure.

Through the technical solution of the present invention, the distribution characteristics of welding spots of the prior art dimple heat exchanger can remain unchanged; the heat exchanging efficiency and the product performance can be improved and so the cost is saved on; insufficient tossing and mixing of the fluid in a dimple heat exchanger can be effectively remedied.

It can be learned from the prior art that the fluid diversion efficiency of a traditional dimple heat exchanger is lower than that of a chevron heat exchanger and is difficult to control. The technical solution of the present invention can effectively solve the problem of fluid separation. A higher heat exchanging efficiency is achieved by adjusting the inlets and outlets of the heat exchanging units so that the heat exchanger can have a higher heat exchanging performance and the present invention facilitates the design and manufacturing. For a traditional dimple heat exchanger, if the fluid distribution in different areas needs to be adjusted, it is a practice that only heat exchanging units having the same depth but different structures can be used. Such a processing method makes it difficult to achieve a smooth transition between different heat exchanging units, and brings about the problem of the difficulty in regulating the intensity and the fluid distribution. However, the present invention can keep the major profile of heat exchanging units unchanged, so such a problem is avoided.

The above are only some embodiments of the present invention. Those skilled in the art can understand that variations can be made to these embodiments, without departing from the principle and spirit of the overall inventive concept of the present invention, and the scope of the present invention is defined by the claims and their equivalents.

What is claimed is:

1. A heat exchanging plate, said heat exchanging plate comprising depressions and/or protrusions, wherein said heat exchanging plate is provided with a plurality of heat exchanging units, and at least one inlet and/or at least one outlet of flow paths of said at least one heat exchanging unit are/is restricted, wherein at least one inlet and/or at least one outlet of the flow paths of at least one heat exchanging unit of the plurality of heat exchanging units on said heat exchanging plate have/has a cross-section different from those of the inlets and/or outlets of other neighboring heat exchanging units of the plurality of heat exchanging units.

2. The heat exchanging plate as claimed in claim 1, wherein at least one inlet and/or at least one outlet of said at least one heat exchanging unit are/is configured to be adjustable, with a layout and welding spot profile of said heat exchanging unit not changed.

3. The heat exchanging plate as claimed in claim 1, wherein a transitional curved surface between adjacent depressions and/or protrusions in at least one heat exchanging unit of said heat exchanging plate is configured to be restricted.

4. The heat exchanging plate as claimed in claim 2, wherein at least one of pressure drop, heat exchanging performance, and volume of the whole plate type heat exchanger is/are configured to be regulated through at least one of the following parameters of at least some areas of said heat exchanging plate:

Ta: edge spacing between two adjacent protrusions or the shortest distance between two adjacent protrusions on said heat exchanging plate, Tb: edge spacing between two adjacent depressions or the shortest distance between two adjacent depressions, wherein the distance connection line of said Tb and the distance connection line of said Ta intersect with each other in space, Ha: vertical distance between the highest location of the heat exchanging plate and the lowest location of an upper surface of a depressed transitional curved line connected across Ta, Hb: vertical distance between the lowest location of the heat exchanging plate and the highest location of a lower surface of a protruded transitional curved line connected across Tb, Wa: distance between two ends of the curved line corresponding to Ha, Wb: distance between two ends of the curved line corresponding to Hb, e: vertical distance between the highest location and depressions on the top surface of the heat exchanging plate, or vertical distance between the lowest location and protrusions on the bottom surface of the heat exchanging plate.

5. The heat exchanging plate as claimed in claim 4, wherein the pressure drop on the two sides, heat exchanging performance, volume and/or asymmetry of the heat exchanging plate are/is configured to be regulated by adjusting Ha and Hb of at least some areas to regulate the minimum flow cross-section of the inlet on at least one side of the heat exchanging unit, with Ta and Tb of said at least some areas of the heat exchanging plate not changed.

6. The heat exchanging plate as claimed in claim 5, wherein said adjusting of the parameters Ha and Hb comprises increasing Hb while reducing Ha, or reducing Hb while increasing Ha.

7. The heat exchanging plate as claimed in claim 4, wherein said parameters satisfy the following relationship:

$$Ha \approx \frac{Ta}{Ta+Tb} \times e,\ Hb \approx \frac{Tb}{Ta+Tb} \times e.$$

8. A plate type heat exchanger, comprising, as a stacked plurality, the heat exchanging plates as claimed in claim 1, a heat exchanging passage being formed between two adjacent stacked heat exchanging plates.

9. The plate type heat exchanger as claimed in claim 8, wherein the corresponding heat exchanging units in two adjacent heat exchanging plates cooperate with each other to form a basic heat exchanging cell when said heat exchanging passage is formed, and the cross-section shape of at least one inlet of at least one of said basic heat exchanging cells is asymmetric with respect to the plate plane, wherein said plate plane is welding planes of two adjacent heat exchanging plates.

10. The plate type heat exchanger as claimed in claim 9, wherein the cross-section of said at least one inlet has different heights on the two sides of the plate plane.

11. The plate type heat exchanger as claimed in claim 9, wherein the center of gravity of the cross-section of said at least one inlet is not on said plate plane.

12. The plate type heat exchanger as claimed in claim 8, wherein at least one outlet of at least one of said basic heat exchanging cells is asymmetric with respect to the plate plane.

13. The plate type heat exchanger as claimed in claim 8, wherein when a fluid flows past a plurality of basic heat exchanging cells in said heat exchanging passage, a plurality of said basic heat exchanging cells are configured to allow the fluid to undulate up and down relative to the plate plane.

14. The plate type heat exchanger as claimed in claim 9, wherein the cross-sectional height and/or cross-sectional area of the cross-section of at least one inlet and/or outlet above said plate plane are/is greater than the cross-sectional height and/or cross-sectional area below said plate plane, and the cross-sectional height and/or cross-sectional area of the cross-section of at least one inlet and/or outlet above said plate plane are/is smaller than the cross-sectional height and/or cross-sectional area below said plate plane.

15. The plate type heat exchanger as claimed in claim 9, wherein the center of gravity of the cross-section of said at least one inlet and/or outlet is above and/or below said plate plane.

16. The plate type heat exchanger as claimed in claim 14, wherein said at least one inlet is arranged alternately or arranged in accordance with a preset rule, and/or said at least one outlet is arranged alternately or arranged in accordance with a preset rule.

17. The plate type heat exchanger as claimed in claim 9, wherein a plurality of said basic heat exchanging cells are configured to allow the fluid to undulate up and down relative to the plate plane in a single flow direction and/or a plurality of flow directions of the fluid.

18. The plate type heat exchanger as claimed in claim 9, wherein the cross-sectional area of the cross-section of said at least one inlet and/or at least one outlet in one direction on said plate plane is greater than a cross-sectional area of the cross-section in another direction.

* * * * *